United States Patent [19]

Luedy

[11] Patent Number: 4,854,915

[45] Date of Patent: Aug. 8, 1989

[54] POST-MASTECTOMY GARMENT

[76] Inventor: Joyce A. Luedy, 1917 Wedgewood Dr., Carolina Trace, Sanford, N.C. 27330

[21] Appl. No.: 247,848

[22] Filed: Sep. 22, 1988

[51] Int. Cl.[4] ..... A41C 3/14

[52] U.S. Cl. ..... 450/31; 450/32; 450/54; 450/55

[58] Field of Search ..... 450/54, 55, 39, 31, 450/32; 2/114, 113

[56] References Cited

U.S. PATENT DOCUMENTS

| | | | |
|---|---|---|---|
| D. 232,602 | 9/1974 | Greenblatt | D2/24 |
| 401,015 | 4/1889 | Denzel | 450/54 |
| 647,154 | 4/1900 | Phillips | 2/113 |
| 1,632,137 | 6/1927 | Jackson | 450/32 |
| 1,845,011 | 2/1932 | Yerkes . | |
| 2,341,032 | 2/1944 | Freed et al. | 450/32 |
| 2,595,139 | 4/1952 | Hart | 450/32 X |
| 2,599,302 | 6/1952 | Von Thaden | 450/32 X |
| 2,661,470 | 12/1953 | Day | 450/54 |
| 2,752,602 | 7/1956 | Wilhelm | 2/273 |
| 2,794,983 | 6/1957 | O'Leary | 450/54 |
| 2,869,552 | 1/1959 | Smith | 450/32 |
| 2,877,771 | 3/1959 | Slotoroff | 450/32 X |
| 3,212,503 | 10/1965 | Gorman | 450/32 |
| 3,348,241 | 10/1967 | Dodds | 450/54 |
| 3,384,091 | 5/1968 | Block | 450/54 |
| 3,447,538 | 6/1969 | Keown | 128/478 |
| 3,498,297 | 3/1970 | Lord | 450/54 |
| 3,565,081 | 2/1971 | Barg | 2/73 |
| 4,100,621 | 7/1978 | Ettipio | 2/114 |
| 4,378,805 | 4/1983 | Reichert et al. | 450/31 X |
| 4,380,569 | 4/1983 | Shaw | 450/55 X |
| 4,412,542 | 11/1983 | Reichert | 450/54 |
| 4,637,398 | 1/1987 | Sherwood | 450/54 |
| aaa4,781,650 | 11/1988 | Budd | 450/55 |

FOREIGN PATENT DOCUMENTS

| | | | |
|---|---|---|---|
| 537330 | 2/1957 | Canada | 450/55 |
| 818751 | 7/1969 | Canada | 450/55 |
| 479290 | 11/1969 | Fed. Rep. of Germany | 450/55 |

*Primary Examiner*—Werner H. Schroeder
*Assistant Examiner*—Jeanette E. Chapman
*Attorney, Agent, or Firm*—Lynn E. Barber

[57] ABSTRACT

The invention comprises post-mastectomy garments having one or two pockets in the breast area of a facing that is attached to a bodice of the garment. In one or both of the pocket areas may be placed a breast prosthesis, preferably constructed of a light-weight, flexible material. The invention is especially useful in construction of garments for casual or house wear.

12 Claims, 4 Drawing Sheets

POST-MASTECTOMY GARMENT

BACKGROUND OF THE INVENTION

1. Field of the Invention

This invention relates to post-mastectomy garments that may be worn by women to conceal the absence of one or both breasts. In particular, the invention pertains to garment facings designed so that soft breast prostheses may be inserted in interior pocket structures formed in attached facings.

2. Description of the Related Art

Women who have had mastectomy operations often wear prosthetic garments to enable them to maintain a normal body shape without undergoing breast reconstruction. These garments are generally in the form of special brassieres that hold one or two prosthetic devices to simulate one or both breasts. These special brassieres are often uncomfortable and heavy or restrictive of movement. Women who have had mastectomy operations who wish to be relieved of the discomfort associated with the prosthetic brassieres or who otherwise are unwilling or unable to wear them at all times need comfortable garments that may be used with lightweight soft breast prostheses for wear at home and for less formal wear.

Garments have been designed with various prosthesis attachments. Some garments are designed with pockets of various types to hold a prosthesis. Prosthesis pockets incorporated directly into a garment may be visible through the garment itself. For example, the prosthetic lounge wear of Dodds (U.S. Pat. No. 3,348,241) comprises garments with a bodice. A prosthesis is placed in a pocket that is attached to the bodice and that has vertical sides opening interiorly within the garment bodice. This patent, and all others cited herein, are incorporated herein by reference.

In Barg, U.S. Pat. No. 3,565,081, sealable pockets are placed between a slip and an inner fitted bodice portion inside the slip, each of which pockets has a slot extending across the outside of the slip near the top of the pocket, which may be closed with a fastener. The undervest of Phillips (U.S. Pat. No. 647,154) comprises a pocket in an undervest garment, the pocket being open at the top and partially divided at the center of the bodice area. A two-parted prosthesis having a part that fits in each half of the pocket and a slender neck between the two parts is placed in the pocket.

Other garments include brassieres, for example, an undershirt with brassiere elements sewn inside the bodice area and a connected outer garment (Keown, U.S. Pat. No. 3,447,538), and a brassiere-containing vest (U.S. Des. Pat. No. 232,602). A bust form may also comprise a discardable pad and a washable fabric envelope to hold the pad, the whole bust form being attachable to a garment (U.S. Pat. No. 1,845,011). The prosthesis may also removably attach to the inside of the garment by means of mating fastening means (U.S. Patent No. 4,100,621).

The patent of Reichert (U.S. Pat. No. 4,412,542) for a robe garment for mastectomy patients has an inner garment panel that includes a back panel section and a front panel section and shoulder straps so that the panel circumscribes the patient's torso in the breast area and back area. The front panel has breast cup members having a front wall of structural fabric that projects outward to form the contour of a breast and a back wall of soft material. A breast prosthesis may be placed between the two walls of the front panel. Like a brassiere, such a panel that circumscribes the person's body may bind and be very uncomfortable for a person who has undergone a mastectomy.

In addition to the discomfort of many post-mastectomy garments, most of the garments to which prostheses may be attached or which have pockets in which prostheses may be inserted require special construction, which may increase the expense of manufacture of the garment. In addition, the design of many of these prosthetic garments is not easily adaptable to a wide variety of types of garment. Others are limited in the type of prosthesis that may be utilized in association with the garment.

It is therefore an object of this invention to provide a post-mastectomy garment style that is suitable for a wide variety of garments, including casual wear and nightwear.

It is a further object of this invention to provide a post-mastectomy garment that is comfortable to the wearer.

It is a further object of this invention to provide a post-mastectomy garment in which a light weight prosthesis may be used.

It is a further object of this invention to provide a garment that may be worn either as a post-mastectomy garment or as a padded garment by women with small breasts.

It is a further object of this invention to provide a garment that may be worn with a variety of prostheses.

Other objects and advantages will be more fully apparent from the following disclosure and appended claims.

SUMMARY OF THE INVENTION

The invention generally comprises a post-mastectomy garment. In particular, garments according to the invention have one or two pocket areas in a facing that is attached to a bodice of the garment. In one or both of the pocket areas a breast prosthesis may be placed, preferably constructed of a light-weight, flexible material. The invention is especially useful in garments for casual or house wear when the wearer wishes to appear of normal body proportions but does not wish to or does not have time to put on other prosthetic undergarments.

Other aspects and features of the invention will be more fully apparent from the following disclosure and appended claims.

DETAILED DESCRIPTION OF THE INVENTION AND PREFERRED EMBODIMENTS THEREOF

There are two primary embodiments of this invention. In the first embodiment, an ovoid pocket piece is attached to the breast area of a frontal facing piece that extends across the breast area to the side seams. In the second embodiment, the pocket piece is also attached to the facing piece, at the upper and lower edges of the pocket piece, but extends to the side seams, rather than being ovoid.

As discussed below modifications of each of these embodiments include variation in the size and shape of the facing and pocket piece, the nature of garment with which it is used (for example, front opening or not, the type of fabrics used, whether a prosthesis is used in one or both pockets, the type of prosthesis used, the position of the pocket opening, and the type of pocket closures used).

Figure 1:
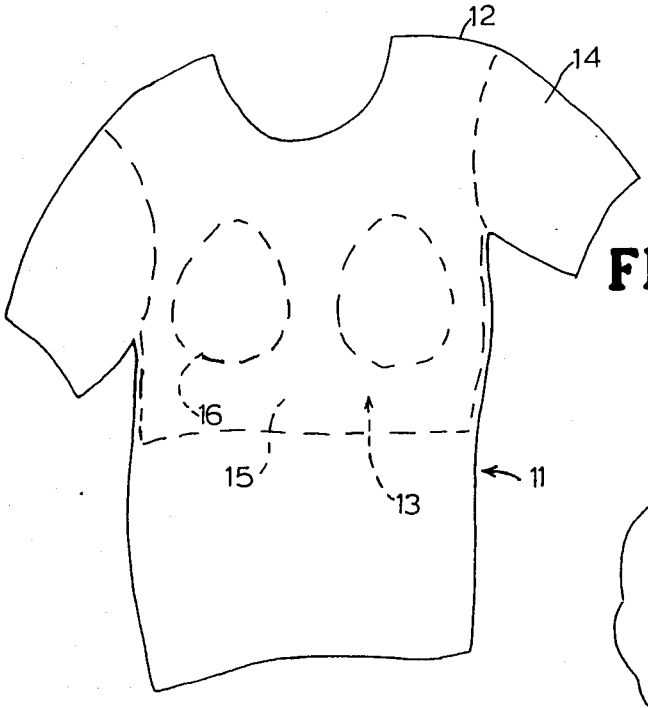
FIG. 1 shows a first embodiment of the invention as used in a t-shirt and having a single front facing.
Figure 2:
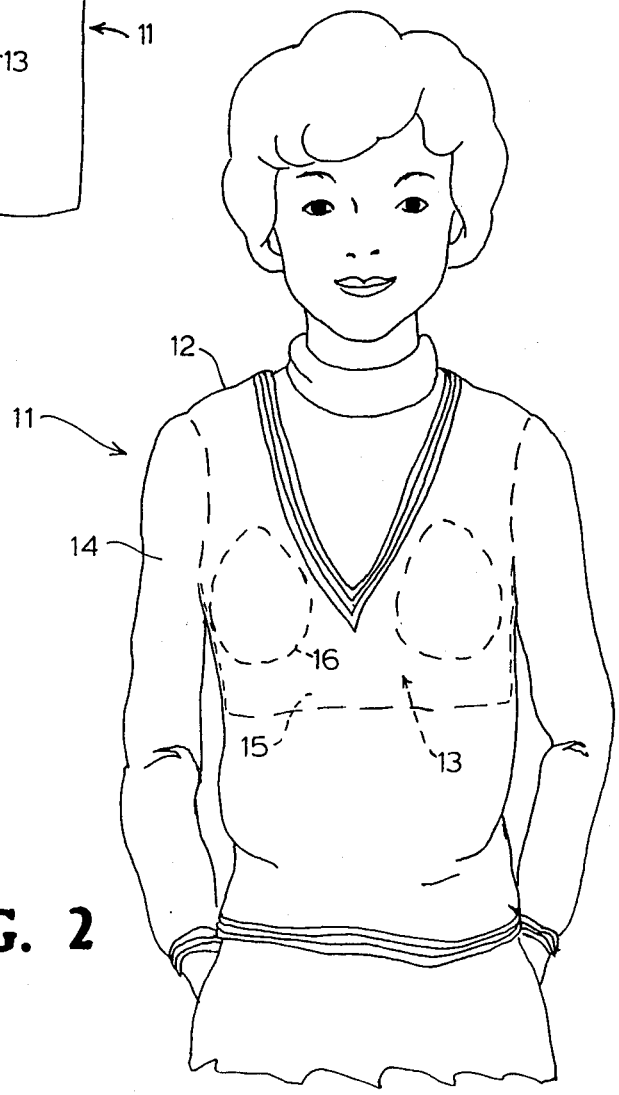
FIG. 2 shows how the first embodiment of the invention may be used in a single front facing in v-neck shirt.
Figure 3:
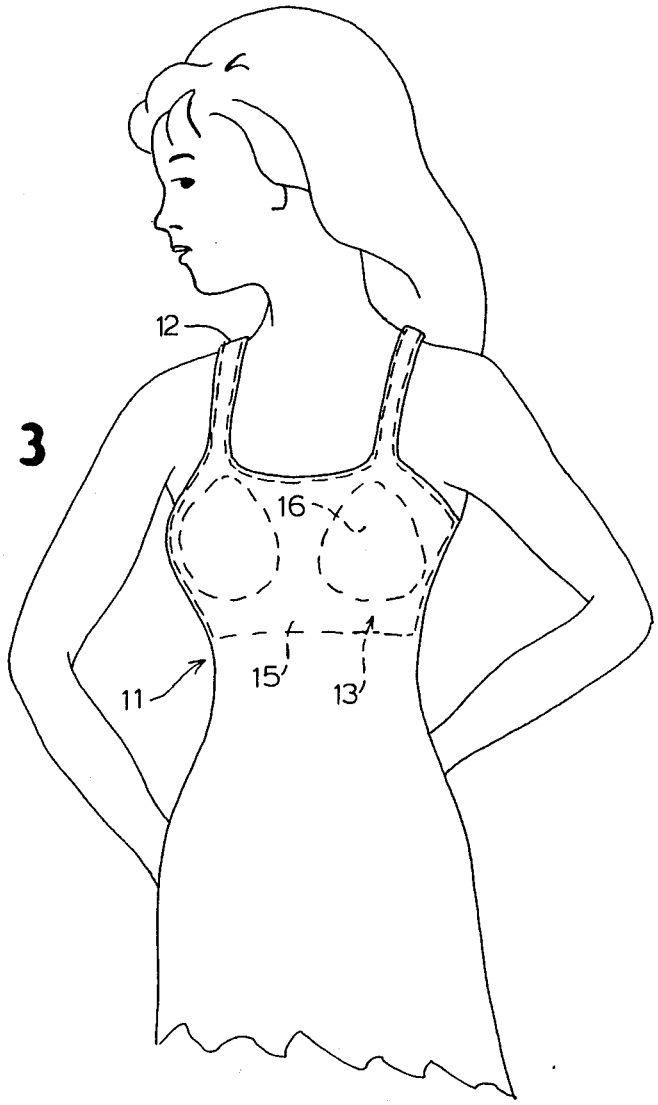
FIG. 3 shows the first embodiment of the invention as used with a single front facing in a garment with straps.
Figure 5:
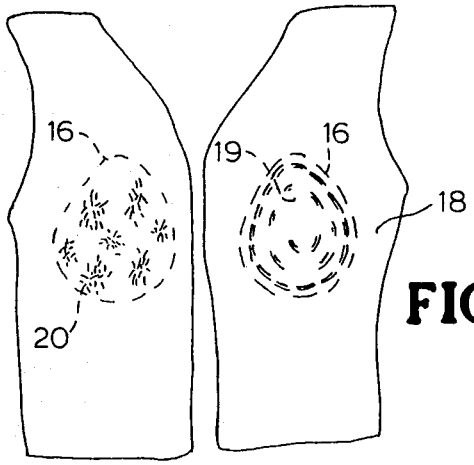
FIG. 5 shows the two-piece facing that may be sewn into the front of a front-opening garment according to the invention.
Figure 4:
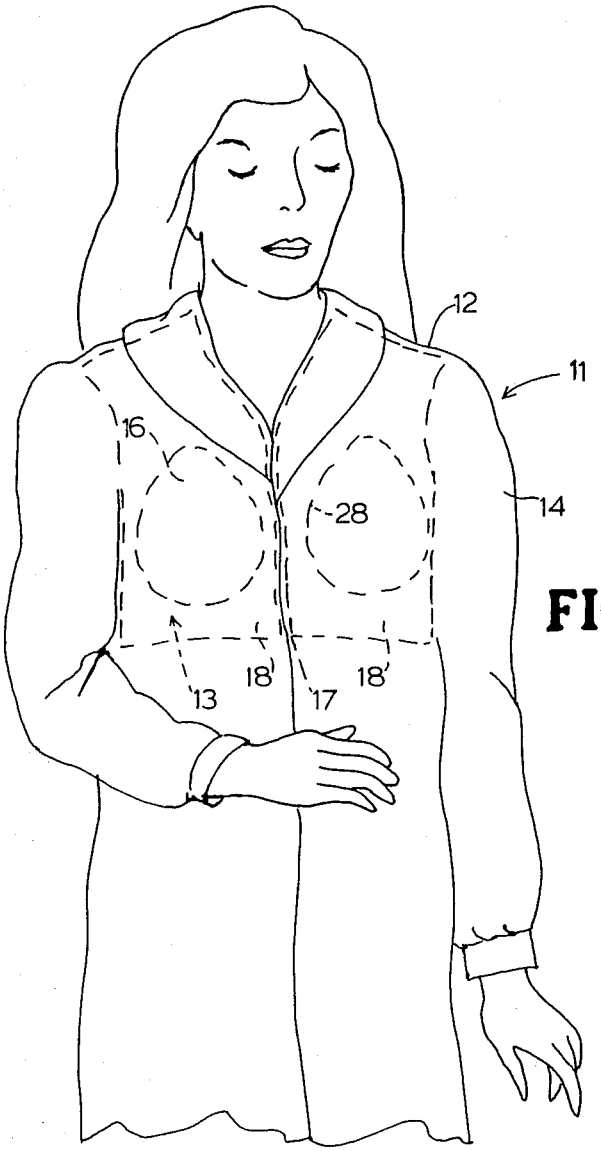
FIG. 4 shows a front-opening garment having the facing and pockets of the invention.
Figure 6:
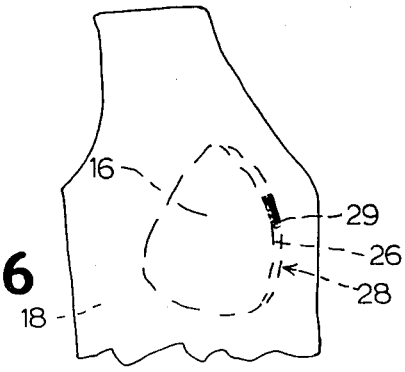
FIG. 6 shows a pocket and pocket opening according to the invention as placed in a facing.

The first embodiment of the present invention as shown in FIGS. 1–6 comprises a garment bodice 11 having a shoulder area 12 and a breast area 13. The bodice 11 may be sleeveless (FIG. 3) or have sleeves 14 (FIGS. 1, 2 and 4). A facing piece 15 attached inside the bodice 11 extends across both breast areas 13 in garments that do not have a central front opening (FIGS. 1–3). In garments with a central front opening 17, two facing pieces 18, one on the left and one on the right side, are attached inside the garment bodice 11 (FIG. 4). These facing pieces 15 and 18 provide a place for attachment of two ovoid prosthesis pockets 16, one in each breast area 13 of the garment. The shape of the facing in this embodiment and in the second embodiment (below) is not critical except that it should cover the breast area 13 and be attached to the bodice 11 of the garment. A traditional jacket or blouse facing or swimming suit facing, which has been extended if necessary to cover the breast area, may be used as a starting point for adapting the invention for use in a particular garment. Alternatively a new facing may be added to a preconstructed garment, or the facing and pocket may be sewn into a garment during construction of the garment.

In the first embodiment, a prosthesis pocket 16 is placed in one or both of the breast areas 13 of the facing 15 or 18. To minimize visibility of the pocket 16 and facing 15,18, both are preferably of the same color as the garment, particularly in garments made of fabric through which the facing can be seen. For garments that are made of heavy or coarse material, the pocket and facing may be made of a lighter weight material of the same or similar color as the garment. The facing material is preferably soft and comfortable to wear next to the body. The preferred fabric for facings and pockets (or the pocket-forming facings of the second embodiment) is stretchable fabric such as knits of cotton, cotton/polyester, nylon, etc. to allow for insertion of a prosthesis and for smooth, snug fitting of the prosthesis within the pocket. Placement of the fabric so that the stretch is from side-to-side is preferred and allows for ease of movement of the wearer and also prevents downward sagging of the pocket when a heavier prosthesis is used.

Preferably, a prosthesis pocket 16 is placed in each breast area 13, so that the garment may be worn by persons who have had two mastectomies, or by those who have had either a right or left mastectomy. In the latter case, a prosthesis is not placed in the pocket 16 on the side with a normal breast unless the woman wishes to augment her normal breast size. The garment with prosthesis placed in both pockets may also be worn by women who have not had any mastectomies but who wish to wear a garment that will enable them to appear to have fuller breasts.

The prosthesis pocket 16 in the first embodiment is preferably constructed by sewing a pocket piece on the inside of the facing in the breast area. The form of the prosthesis pocket 16 in this embodiment is generally oval or rounded as shown in FIGS. 1–6, so that it conforms to the shape of a breast-shaped prosthesis 19. The pocket may be slightly teardrop shaped as shown in FIGS. 1–6 (or could be otherwise irregularly shaped) to provide a place for placement of stuffing material around the prosthesis in the pocket or to allow an unencased prosthesis (see below) to be formed and extended into areas around the breast area where the mastectomy surgical process has removed tissue and has left a depression.

Any type of breast prosthesis 19 may be placed in the pocket. The preferred prosthesis 19 is soft and made of washable, flexible material. Thus, a soft stuffing material of the appropriate breast-simulating shape may be encased in a, soft fabric material, somewhat like a small pillow to form the prosthesis. The pillow prosthesis may have an opening for removal, addition or adjustment of the location of the stuffing material 20.

The pocket is also designed so that free, unencased stuffing material 20 may be placed in the pocket to achieve the desired shape and size. Particularly useful as a loose unencased stuffing material 20 is polyester fiber filling or other soft, pliable material that is washable and holds its shape even when washed. Thus, the desired amount of this loose material may be placed in the pocket and formed into the appropriate shape after the garment is purchased. The garment may then be washed and worn without needing to remove or separately clean the prosthesis.

Another advantage of using the unencased fiber filling for a prosthesis is that this material is easily formed into a variety of shapes such as that of a naturally hanging breast. Thus a woman who has had one breast removed by mastectomy may wish to simulate the form of the natural breast in the pocket over the surgical area by forming a prosthesis of the appropriate shape. The loose fiber filling is also very comfortable to wear and may even be used for prosthesis in nightwear for those who wish to sleep in garments with prostheses in them.

The loose unencased stuffing may be less useful than a firm ready-made prosthesis in garments made of very fine thin fabrics because irregularities or lumps in the prosthesis may show through these fabrics. Heavier vests, shirts or other overgarments may be worn over thinner fabric garments when the loose stuffing is used for the prosthesis to avoid this problem. Generally, in garments of thicker or heavier fabrics such as terry cloth, quilting, knits, shirting etc. the loose unencased stuffing may be easily formed to provide prostheses that present a realistic shape in the garment.

Another soft light weight prosthesis that may be used in the pockets of the invention comprises a fabric breast cup form sold commercially for sewing purposes and that may be filled with fiber filling. The filling may then be enclosed by sewing a soft piece of fabric across the back of the cup. Fabric panels in which breast form cups are integrally inserted by the manufacturer may be also used as a facing. The cups may be filled with fiber filling and a soft backing may be sewed across the back of the cup to form a prosthesis pocket.

It is important that a prosthesis fit snugly and be relatively unmovable within a pocket of the invention so that the movement of the prosthesis does not result in an unwanted appearance. The tear-drop shaped pockets may thus be made of a size to hold a particular size prosthesis. Alternatively, a larger pocket size of any embodiment can be decreased after manufacture so that the prosthesis will be positioned where desired and will not shift position (see the discussion on the second embodiment below).

Figure 7:
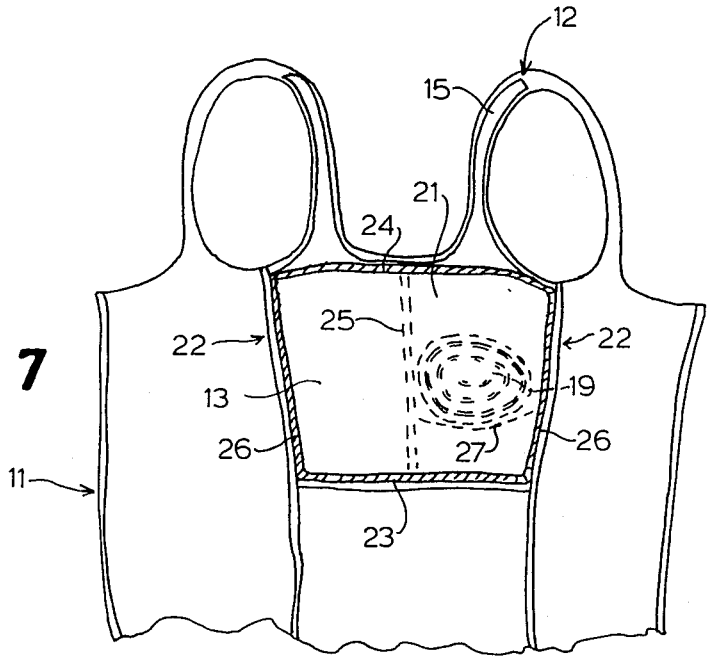
FIG. 7 shows a pocket-facing of the second embodiment of the invention.

A second embodiment of the facing prosthetic invention is shown in FIG. 7. The ovoid pocket 16 of the first embodiment is replaced in this embodiment by a pocket-forming facing 21 that extends over the breast area to the side seams 22 and is attached to the facing 15 at its lower edge 23 and at the upper edge 24 of the pocket facing 21. The addition of one or more stitching lines 25 at the middle of the pocket facing 21 centrally holds the pocket-facing 21 to the facing 15, keeps the prosthesis 19 placed in each side from moving centrally and provides separation between the breast areas 13. There is an opening 26 preferably at each side seam 22 between the facing 15 and pocket facing 21 for insertion of the prosthesis 19 and which may be closed in the same manner as with the first embodiment (below). The opening 26 may also be located at other edge positions as convenient for a particular garment.

A major advantage of the second embodiment of the invention is that the same garment may easily be produced for persons of various breast sizes, shapes and positions. Thus, a garment made with a large pocket area between the facing and pocket facing as shown in FIG. 7 may be fitted to any of a variety of body forms. For this fitting process, the woman tries on the garment with a prosthesis inserted in the pocket area. The actual or desired location of the breast area is marked temporarily on the fabric. A line of stitching 27 may then be made, such as across the bottom of the breast area across the facing and pocket facing, to enable placement of the prosthesis in the appropriate position as shown in FIG. 7. Adhesive-backed velcro may also be inserted inside the pocket area between the facing and pocket-facing at the appropriate location(s) to decrease the inner dimension(s) of the pocket area.

In the embodiment shown in FIGS. 1–3 having no front opening, the pocket preferably opens at the underarm side of the breast area because it is generally easier to remove and insert a prosthesis from the side of the pocket when the garment does not have a central front opening. In the embodiment shown in FIG. 4, having a front opening 17, the pocket preferably opens at the central edge 28 of the pocket so that it is easier to insert the prosthesis in the pocket 16. The pocket in this embodiment is attached to the facing at all edges of the pocket except the central edge 28.

Figure 8:
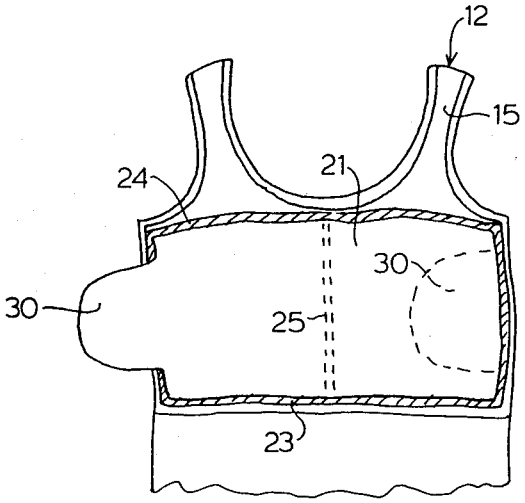
FIG. 8 shows the pocket flaps of the invention.

The pocket opening may be closed using any type of garment closure, but Velcro ® or other self-adhesive or adhesive substance provides a very efficient, simple type of closure 29. Simplification of construction of the pocket is obtained by using closure material that adheres to the garment without sewing such as adhesively backed Velcro ®. Another simple type of closure is provided by addition of a flap 30 on the pocket piece 16 at the opening area 26 of the pocket (FIG. 8). The flap 30 should be large enough to remain tucked in the pocket and to hold the prosthesis in the pocket when the flap is tucked in around the prosthesis. The flap 30 should not be so large that it forms a bulky mass in the pocket. Thus, a shown in FIG. 8 for a side opening, the flap 30 may be extended outward to enable easy insertion of the prosthesis 19 or it may be tucked into the pocket opening between the facing and the pocket or pocket-facing if no prosthesis is used on that side or after a prosthesis has been inserted. A flap 30 works particularly well as a closure when a soft light weight prosthesis is used. The flap closure as well as the other types of closures may be used at openings at any position around the pocket outer edges.

The pocket opening 26 is of a size to enable insertion of a breast prosthesis 19. In some cases, for example, where loose, unencased stuffing material is used to form the prosthesis (see below), the opening may be very small and no additional means of closure is necessary as a prosthesis of this material does not tend to move or shift position significantly within the pocket.

In the embodiments of this invention, the facing is preferably relatively closely fitting about the body of the wearer so that the prostheses remain correctly positioned when the body moves. Thus, the invention works best when the garment itself is at least somewhat fitted. The facing may be attached to the bodice at seam areas, such as the shoulder seam and the side seam area beneath the arm. It is not generally attached to the garment along the bottom of the facing unless there is a seam in that area of the garment. The facing and pocket of the invention may also be used in strapless, shoulderless garments by attaching it to the front neckline of the garment.

It is emphasized that although this invention has as its main purpose the provision of a post-mastectomy garment, it also may be used by women with small breasts who wish to wear a garment that will provide an appearance of a larger breast size. An amount of unencased stuffing material may be placed in a pocket of the invention to achieve the desired effect. Alternatively, brassiere cup forms available commercially may be inserted in the pockets, and additional fiber filling added as padding if necessary. This latter embodiment is especially useful with sun-dresses or sleeveless garments having thin straps or no straps where wearing a brassiere with straps is undesirable.

While the invention has been described with reference to specific embodiments thereof, it will be appreciated that numerous variations. modifications and embodiments are possible, and accordingly, all such variations, modifications, and embodiments are to be regarded as being within the spirit and scope of the invention.

What is claimed is:

1. A woman's garment for use with a breast prosthesis in a frontal breast area of the garment, comprising:

(a) a facing piece placed inside the frontal breast area of the garment, said facing piece comprising a breast section, said facing piece connected to the garment at the garment sideseam area; said facing piece not extending to the back of the garment; and (b) a pocket piece attached inside the breast section of the facing to form a pocket, said pocket being of a size and shape to hold a breast prosthesis, said pocket piece and said facing each being made of soft flexible material, said pocket having an operation for insertion of the breast prosthesis wherein the breast prosthesis used affects the appearance of the frontal breast area of the garment.

2. A woman's garment for use with a breast prosthesis according to claim 1, wherein the breast prosthesis comprises an unencased washable, fibrous filling material.

3. A woman's garment for use with a breast prosthesis according to claim 1, wherein the pocket is closable by means of a self-adhesive fastening means.

4. A woman's garment for use with a breast prosthesis according to claim 1, wherein the pocket is closable by means of a flap.

5. A woman's garment for use with a breast prosthesis according to claim 1, wherein the shape of the pocket piece is ovoid.

6. A woman s garment for use with a breast prosthesis according to claim 1, wherein the garment has a front opening and there are two facing pieces.

7. A woman's garment for use with a breast prosthesis according to claim 6, wherein there are two pocket pieces, each said pocket piece comprising a panel extending across one breast area.

8. A woman's garment for use with a breast prosthesis according to claim 6, wherein the pocket opening is towards the front opening of the garment.

9. A woman's garment for use with a breast prosthesis according to claim 1, wherein the facing piece extends across the front of the garment.

10. A woman's garment for use with a breast prosthesis in a frontal breast area of the garment comprising:

(a) a facing piece placed inside the frontal breast area and extending across the front of the garment, said facing piece comprising a breast section, said facing piece connected to the garment at garment side-seam area; said facing piece not extending to the back of the garment and (b) a pocket piece attached inside the breast section of the facing to form a pocket, wherein the pocket piece comprises a panel extending across both breast areas and a line of stitching between the breast areas holds the pocket piece to the facing piece; said pocket being of a size and shape to hold a breast prosthesis; said pocket piece and said facing piece each being made of soft flexible material; said pocket having an opening for insertion of the breast prosthesis.

11. A woman's garment for use with a breast prosthesis according to claim 10, wherein the pocket opening is toward the side of the garment.

12. A woman's garment for use with a breast prosthesis according to claim 1, wherein the garment has a shoulder area and the facing piece is connected to the garment at the shoulder area of the garment.

* * * * *

UNITED STATES PATENT AND TRADEMARK OFFICE

CERTIFICATE OF CORRECTION

PATENT NO. : 4,854,915

DATED : August 8, 1989

INVENTOR(S) : Joyce A. Luedy

It is certified that error appears in the above-identified patent and that said Letters Patent is hereby corrected as shown below:

Column 4, line 4, change "prothesis" to --protheses--.

Column 4, line 49, change "prothesis" to --protheses--.

Column 6, lines 67-68 change "operation" to --opening--.

Signed and Sealed this

Nineteenth Day of June, 1990

*Attest:*

HARRY F. MANBECK, JR.

*Attesting Officer*

*Commissioner of Patents and Trademarks*